US011414812B2

(12) United States Patent
Sun et al.

(10) Patent No.: US 11,414,812 B2
(45) Date of Patent: Aug. 16, 2022

(54) CLOTHING CARE MACHINE AND CONTROL METHOD THEREOF

(71) Applicant: TSANN KUEN (ZHANG ZHOU) ENTERPRISE CO., LTD., Zhang Zhou (CN)

(72) Inventors: Xiaosen Sun, Zhangzhou (CN); Ruifeng Cai, Zhangzhou (CN); Weimin Zheng, Zhangzhou (CN)

(73) Assignee: TSANN KUEN (ZHANG ZHOU) ENTERPRISE CO., LTD., Zhang Zhou (CN)

( * ) Notice: Subject to any disclaimer, the term of this patent is extended or adjusted under 35 U.S.C. 154(b) by 48 days.

(21) Appl. No.: 17/037,397

(22) Filed: Sep. 29, 2020

(65) Prior Publication Data

US 2021/0156074 A1 May 27, 2021

(30) Foreign Application Priority Data

Nov. 22, 2019 (CN) ..... 201911157034.0

(51) Int. Cl.
*F26B 3/00* (2006.01)
*D06F 58/38* (2020.01)
(Continued)

(52) U.S. Cl.
CPC ..... *D06F 58/38* (2020.02); *D06F 58/203* (2013.01); *D06F 2103/34* (2020.02);
(Continued)

(58) Field of Classification Search
CPC .... D06F 58/38; D06F 58/203; D06F 2103/34; D06F 2105/32; D06F 2105/40; D06F 2105/56
(Continued)

(56) References Cited

U.S. PATENT DOCUMENTS 3,269,027 A * 8/1966 Harnden, Jr. ..... D06F 34/26 34/547
2003/0034443 A1* 2/2003 Kouznetsov ..... F26B 25/22 250/222.2
(Continued)

FOREIGN PATENT DOCUMENTS

CN 1908284 A 2/2007
CN 102656315 A 9/2012
(Continued)

*Primary Examiner* — John P McCormack
(74) *Attorney, Agent, or Firm* — Cheng-Ju Chiang

(57) ABSTRACT

A clothing care machine and a control method thereof are provided. The clothing care machine includes a drying chamber, an air supply device, a first humidity sensor and a second humidity sensor. The drying chamber is used for containing clothes. The air supply device is communicated with the drying chamber for supplying hot air to the drying chamber. The first humidity sensor is disposed in the drying chamber to detect the humidity in the drying chamber. The second humidity sensor is disposed outside the drying chamber to detect the ambient humidity outside the drying chamber. The clothing care machine and the control method can automatically judge whether the drying process is completed and stop working according to the humidity change in the drying chamber and the ambient humidity, the judgment is more accurate to effectively improve the drying effect and reduce the energy consumption, and the intelligent degree is higher.

8 Claims, 2 Drawing Sheets

(51) Int. Cl.

| | |
|---|---|
| ***D06F 58/20*** | (2006.01) |
| *D06F 105/56* | (2020.01) |
| *D06F 105/32* | (2020.01) |
| *D06F 105/40* | (2020.01) |
| *D06F 103/34* | (2020.01) |

(52) U.S. Cl.
CPC ..... *D06F 2105/32* (2020.02); *D06F 2105/40* (2020.02); *D06F 2105/56* (2020.02)

(58) Field of Classification Search
USPC ..... 34/491
See application file for complete search history.

(56) References Cited

U.S. PATENT DOCUMENTS

| | | | | |
|---|---|---|---|---|
| 2011/0041562 | A1* | 2/2011 | Balinski | D06F 33/43 34/486 |
| 2011/0047812 | A1* | 3/2011 | Sugimoto | D06F 58/38 454/313 |

FOREIGN PATENT DOCUMENTS

| | | | |
|---|---|---|---|
| CN | 106854827 | A | 6/2017 |
| CN | 107489008 | A | 12/2017 |
| CN | 108004738 | A | 5/2018 |
| CN | 109267307 | A | 1/2019 |
| CN | 109629207 | A | 4/2019 |
| JP | H6-225993 | A | 8/1994 |
| JP | 2001-190897 | A | 7/2001 |

* cited by examiner

CLOTHING CARE MACHINE AND CONTROL METHOD THEREOF

CROSS-REFERENCE TO RELATED APPLICATION

The present invention is based on and claims the priority of Chinese patent application No. 201911157034.0, filed on Nov. 22, 2019. The entire disclosure of the above-identified application is incorporated herein by reference.

TECHNICAL FIELD

The present invention relates to the technical field of household appliances, and in particular, to a clothing care machine and a control method thereof.

BACKGROUND OF THE INVENTION

The existing clothing care machine usually has the functions of wrinkle removal, odor removal and drying. It is easy to use and suitable for family clothing care, bringing quality innovation and improvement to people's life. However, when the existing clothing care machine dries clothes, the drying time is preset, and the existing clothing care machine cannot automatically judge whether the clothes have been dried or not. When the amount of clothes or the degree of dry and wet clothes are different, the drying effect is not good and even the energy consumption is increased.

SUMMARY OF THE INVENTION

In view of the above technical problems, the present invention provides a clothing care machine and a control method thereof, which can automatically judge whether the clothes are dried or not, improve the drying effect and reduce the energy consumption.

In order to solve the above technical problems, the present invention provides a clothing care machine, which includes:

a drying chamber for containing clothes; and a working system including an air supply device, a first humidity sensor, a second humidity sensor and a controller;

wherein the air supply device, the first humidity sensor and the second humidity sensor are each connected with the controller, the air supply device is communicated with the drying chamber and used for supplying hot air to the drying chamber, the first humidity sensor is disposed in the drying chamber to detect the humidity in the drying chamber, the second humidity sensor is disposed outside the drying chamber to detect the ambient humidity outside the drying chamber, the controller is used to control the air supply device to supply hot air to the drying chamber to dry the clothes, judge whether the drying process is completed according to the humidity change in the drying chamber and the ambient humidity, and control the air supply device to stop working when the drying process is completed.

In one embodiment, the controller is used for:

controlling the air supply device to supply hot air to the drying chamber to dry the clothes;

determining the drying delay time according to the humidity change in the drying chamber, and determining the target drying humidity according to the ambient humidity;

starting timing when the chamber humidity is less than or equal to the target drying humidity; and judging that the drying process is completed when the timing reaches the drying delay time.

In one embodiment, the air supply device is further used for supplying cold air to the drying chamber, and the controller is further used for:

controlling the air supply device to supply cold air to the drying chamber before controlling the air supply device to supply hot air to the drying chamber for drying the clothes;

judging, after the cold air supply time reaches a first preset time, whether the clothes are wet according to the chamber humidity and the ambient humidity as detected; and controlling the air supply device to supply hot air to the drying chamber to dry the clothes if it is judged that the clothes are wet.

In one embodiment, the working system further includes a steam generator used for supplying steam to the drying chamber, and the controller is further used for:

controlling the steam generator to supply steam to the drying chamber if it is judged that the clothes are not wet; and when the steam supply time reaches a second preset time, controlling the steam generator to stop working and then controlling the air supply device to supply hot air to the drying chamber to dry the clothes.

The present invention further provides a control method of the clothing care machine, which includes:

controlling the air supply device to supply hot air to the drying chamber of the clothing care machine to dry the clothes in the drying chamber;

judging whether the drying process is completed according to the humidity change in the drying chamber and the ambient humidity; and controlling the air supply device to stop working when the drying process is completed.

In one embodiment, the step of judging whether the drying process is completed according to the humidity change in the drying chamber and the ambient humidity includes:

determining the drying delay time according to the humidity change in the drying chamber, and determining the target drying humidity according to the ambient humidity;

starting timing when the chamber humidity is less than or equal to the target drying humidity; and judging that the drying process is completed when the timing reaches the drying delay time.

In one embodiment, the step of determining the drying delay time according to the humidity change in the drying chamber includes:

calculating the numerical change of the chamber humidity in a unit time; and acquiring the delay time corresponding to an interval where the numerical change is located as the drying delay time.

In one embodiment, before the step of controlling the air supply device to supply hot air to the drying chamber of the clothing care machine, the control method further includes:

controlling the air supply device to supply cold air to the drying chamber;

judging, after the cold air supply time reaches a first preset time, whether the clothes are wet according to the chamber humidity and the ambient humidity; and performing the step of controlling the air supply device to supply hot air to the drying chamber of the clothing care machine if it is judged that the clothes are wet.

In one embodiment, the step of judging whether the clothes are wet according to the chamber humidity and the ambient humidity includes:

acquiring the humidity change in the drying chamber over the first preset time, and acquiring the initial difference between the chamber humidity and the ambient humidity before supplying the cold air; and judging whether the clothes are wet according to the humidity change in the drying chamber over the first preset time and the initial difference between the chamber humidity and the ambient humidity before supplying the cold air.

In one embodiment, the control method further includes:

controlling the steam generator to supply steam to the drying chamber if it is judged that the clothes are not wet; and when the steam supply time reaches a second preset time, controlling the steam generator to stop working and then performing the step of controlling the air supply device to supply hot air to the drying chamber of the clothing care machine.

As described above, the clothing care machine and the control method thereof are provided. The clothing care machine includes a drying chamber, an air supply device, a first humidity sensor and a second humidity sensor. The drying chamber is used for containing clothes. The air supply device is communicated with the drying chamber for supplying hot air to the drying chamber. The first humidity sensor is disposed in the drying chamber to detect the humidity in the drying chamber. The second humidity sensor is disposed outside the drying chamber to detect the ambient humidity outside the drying chamber. The air supply device is controlled by the controller to supply hot air to the drying chamber to dry the clothes, and then, it is judged whether the drying process is completed according to the chamber humidity and the ambient humidity as detected. When the drying process is completed, the air supply device is controlled to stop working, so that it is able to automatically judge whether the drying process is completed and stop working according to the chamber humidity and the ambient humidity, the judgment is more accurate so as to effectively improve the drying effect and reduce the energy consumption, and the intelligent degree is higher.

DETAILED DESCRIPTION OF PREFERRED EMBODIMENTS

In the following, the implementation mode of the present invention is described by specific embodiments. Persons familiar with the technology can easily understand other advantages and effects of the present invention from the contents disclosed in the specification.

In the following description, several embodiments of the present invention are described with reference to the accompanying drawings. It should be understood that other embodiments may be used and that changes in mechanical composition, structure, electricity and operation may be made without departing from the spirit and scope of the present invention. The following detailed description should not be considered restrictive, and the scope of the embodiments of the present invention is limited only by the claims of the patent. The terms used herein are intended to describe specific embodiments only and are not intended to limit the present invention.

Although in some instances the terms "first", "second", etc. are used in the description to describe various elements, these elements should not be limited by these terms. These terms are used only to distinguish one element from another.

First Embodiment

Figure 1:
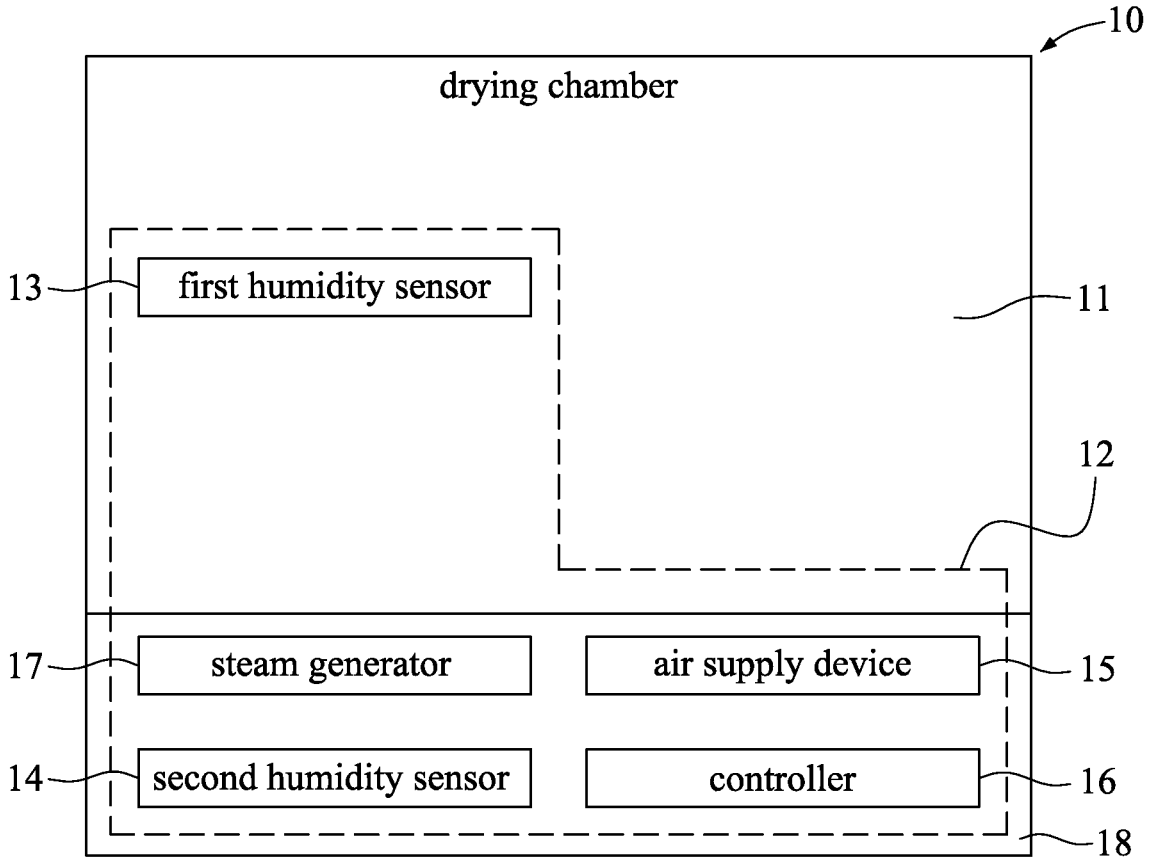
FIG. 1 is a schematic diagram of a clothing care machine according to a first embodiment.

FIG. 1 is a schematic diagram of a clothing care machine according to a first embodiment. Referring to FIG. 1, the clothing care machine 10 of this embodiment includes a drying chamber 11 and a working system 12. The working system 12 includes an air supply device 15, a first humidity sensor 13, a second humidity sensor 14 and a controller 16. The controller 16 is connected with the air supply device 15, the first humidity sensor 13 and the second humidity sensor 14. The drying chamber 11 is used for containing clothes. The air supply device 15 is communicated with the drying chamber 11 and used for supplying hot air to the drying chamber 11. The first humidity sensor 13 is disposed in the drying chamber 11 to detect the humidity in the drying chamber 11 (hereinafter referred to as "chamber humidity"). The second humidity sensor 14 is disposed outside the drying chamber 11 to detect the ambient humidity outside the drying chamber 11. The controller 16 is used to control the air supply device 15 to work according to the detection data of the first humidity sensor 13 and the second humidity sensor 14, so as to realize the intelligent drying of the clothes. In this embodiment, the air supply device 15, the second humidity sensor 14 and the controller 16 are all disposed in a working chamber 18 that is separated from the drying chamber 11, but it is only an example. Alternatively, the second humidity sensor 14 can also be disposed on the outside of a side wall of the drying chamber 11 or at any position where the ambient humidity can be detected.

Specifically, the controller 16 is used to control the air supply device 15 to supply hot air to the drying chamber 11 to dry the clothes, judge whether the drying process is completed according to the humidity change in the drying chamber 11 and the ambient humidity as detected, and control the air supply device 15 to stop working when the drying process is completed.

In actual practice, when judging whether the drying process is completed according to the humidity change in the drying chamber 11 and the ambient humidity as detected, the controller 16 is used for: controlling the air supply device 15 to supply hot air to the drying chamber 11 to dry the clothes; determining the drying delay time according to the humidity change in the drying chamber 11, and determining the target drying humidity according to the ambient humidity; starting timing when the chamber humidity is less than or equal to the target drying humidity; and when the timing reaches the drying delay time, judging that the drying process is completed.

Specifically, after the drying process is started, the numerical change of the chamber humidity in a unit time is calculated, and the delay time corresponding to an interval where the numerical change is located is acquired as the drying delay time. The drying delay time refers to the time of continuing to dry the clothes when they are close to drying. Generally speaking, the chamber humidity is in a rising state within a period of time after the drying process is started. The greater the numerical change of the chamber humidity, it indicates that the clothes may not be very wet but the quantity is large or the clothes are not too much but they are very wet, that is, more moisture is required to be removed, so that the drying delay time is correspondingly longer. By setting different intervals for the numerical change to divide the wet degree of the clothes into different levels which correspond to different drying delay time, the clothes can be ensured to be completely dried under various conditions.

Further, after the drying process is started, the target drying humidity is determined according to the ambient humidity. Generally speaking, the higher the ambient humidity, the greater the difference between the chamber humidity and the ambient humidity when the clothes are close to drying; and the lower the ambient humidity, the smaller the difference between the chamber humidity and the ambient humidity when the clothes are close to drying. Therefore, by determining the target drying humidity according to the ambient humidity, it can correspond to the state that the clothes are close to drying. When the chamber humidity is less than or equal to the target drying humidity, timing is started. When the timing reaches the drying delay time, it is judged that the drying process is completed, so as to completely dry the clothes. After the drying process, the air supply device 15 is controlled to stop working, to automatically exit the drying process and prompt the user to shut down the machine.

Since whether the drying process is completed is judged according to the chamber humidity in combination with the ambient humidity, the drying status of the clothes can be accurately obtained, so that the drying end point and the drying delay time can be accurately judged. In this way, different clothing quantity or different wet degree will automatically correspond to different drying time, so as to ensure that the clothes are completely dried and reduce the energy consumption.

In this embodiment, the air supply device 15 may also be used to supply cold air to the drying chamber 11. The controller 16 is further used to control the air supply device 15 to supply cold air to the drying chamber 11 before controlling the air supply device 15 to supply hot air to the drying chamber 11 for drying the clothes; judge, after the cold air supply time reaches a first preset time, whether the clothes are wet according to the chamber humidity and the ambient humidity as detected; and control the air supply device 15 to supply hot air to the drying chamber 11 to dry the clothes if it is judged that the clothes are wet.

Before controlling the air supply device 15 to supply hot air to the drying chamber 11 to dry the clothes, it is necessary to judge whether the clothes are in a wet state. First, the air supply device 15 is controlled to supply cold air to the drying chamber 11. The temperature of the cold air is lower than that of the hot air, wherein the cold air can be unheated air or heated air with a heating temperature far lower than the hot air. After supplying cold air to the drying chamber for the first preset time, the humidity change in the drying chamber over the first preset time is acquired. Further, the initial difference between the chamber humidity and the ambient humidity before supplying the cold air is also acquired. The setting of the first preset time should consider that the moisture in the clothes put into the drying chamber 11 has diffused to the drying chamber 11 to a certain extent, and at the same time, the working efficiency of the machine is ensured. The initial difference between the chamber humidity and the ambient humidity before supplying the cold air can be detected, calculated and stored before the cold air is supplied to the drying chamber. Finally, whether the clothes are wet or not is judged according to the humidity change in the drying chamber over the first preset time and the initial difference between the chamber humidity and the ambient humidity before supplying the cold air.

In actual practice, the state of the drying chamber 11 before the drying process is started can be very complex. For example, the user may put the clothes into the drying chamber 11 for a period of time before the drying process is started, or may use the machine again in a short time after the last drying process, so as to cause the humidity of the drying chamber 11 to be different before each drying process. Therefore, by supplying cold air to promote moisture diffusion, combined with the humidity change in the drying chamber over the first preset time and the initial difference between the chamber humidity and the ambient humidity before supplying the cold air, it is more accurate to judge whether the clothes are wet or not.

For example, if the user puts the clothes into the drying chamber 11 for a period of time before the drying process is started, the moisture in the clothes has spontaneously and fully diffused to the drying chamber 11, then after supplying cold air to the drying chamber 11, the humidity change in the drying chamber over the first preset time may be very small, but the humidity in the drying chamber before supplying cold air to the drying chamber may be close to or higher than the ambient humidity, resulting in that the initial difference between the chamber humidity and the ambient humidity before supplying the cold air is positive and large. At this time, by combining the humidity change in the drying chamber over the first preset time and the initial difference between the chamber humidity and the ambient humidity before supplying the cold air, it can judge that the clothes are wet.

For another example, the user may use the machine again in a short time after the last drying process. In this case, because the hot air has just been used in the drying chamber 11, the humidity in the drying chamber before supplying cold air to the drying chamber will be far lower than the ambient humidity, resulting in that the initial difference between the chamber humidity and the ambient humidity before supplying the cold air is negative and large. After supplying cold air to the drying chamber for a period of time, the moisture in the clothes diffuses to the drying chamber 11, and the chamber humidity varies greatly over the first preset time. At this time, by combining the humidity change in the drying chamber over the first preset time and the initial difference between the chamber humidity and the ambient humidity before supplying the cold air, it can also judge that the clothes are wet.

That is, when the initial difference between the chamber humidity and the ambient humidity before supplying the cold air is positive and greater than a preset value, or the humidity change in the drying chamber over the first preset time is greater than or equal to a preset threshold, it is judged that the clothes are in a wet state. The preset threshold can be adjusted according to the initial difference between the chamber humidity and the ambient humidity before supplying the cold air. On the contrary, if the initial difference between the chamber humidity and the ambient humidity before supplying the cold air or the humidity change in the drying chamber over the first preset time does not meet the preset condition, it is judged that the clothes are not in a wet state and are dry clothes.

Through the above method, the machine can accurately judge whether the clothes are in a wet state before the drying process is started, and then perform the corresponding controls according to the functions selected by the user.

As shown in FIG. 1, in order to realize wrinkle removal and odor removal of the clothes, the working system 12 of the clothing care machine 10 in this embodiment may further include a steam generator 17. The steam generator 17 is used to supply steam to the drying chamber 11. The controller 16 is further used, if it is judged that the clothes are not wet, to control the steam generator 17 to supply steam to the drying chamber 11, and when the steam supply time reaches a second preset time, control the steam generator 17 to stop working and control the air supply device 15 to supply hot air to the drying chamber 11 to dry the clothes.

Specifically, if it is judged that the clothes in the drying chamber 11 are not wet when the user selects the function of wrinkle removal and odor removal of the clothes, the steam generator 17 is firstly controlled to supply steam to the drying chamber 11 for the second preset time to wet the clothes in the drying chamber 11 to a certain extent, then the steam generator 17 is controlled to stop working, and then the air supply device 15 is controlled to supply hot air to the drying chamber 11 to dry the clothes, and the drying process is as described above, to realize wrinkle removal and odor removal of the clothes and fully dry the clothes.

The clothing care machine of this embodiment includes a drying chamber, an air supply device, a first humidity sensor and a second humidity sensor. The drying chamber is used for containing clothes. The air supply device is communicated with the drying chamber for supplying hot air to the drying chamber. The first humidity sensor is disposed in the drying chamber to detect the humidity in the drying chamber. The second humidity sensor is disposed outside the drying chamber to detect the ambient humidity outside the drying chamber. The air supply device is controlled by the controller to supply hot air to the drying chamber to dry the clothes, and then, it is judged whether the drying process is completed according to the chamber humidity and the ambient humidity as detected. When the drying process is completed, the air supply device is controlled to stop working, so that it is able to automatically judge whether the drying process is completed and stop working according to the chamber humidity and the ambient humidity, the judgment is more accurate so as to effectively improve the drying effect and reduce the energy consumption, and the intelligent degree is higher.

Second Embodiment

Figure 2:
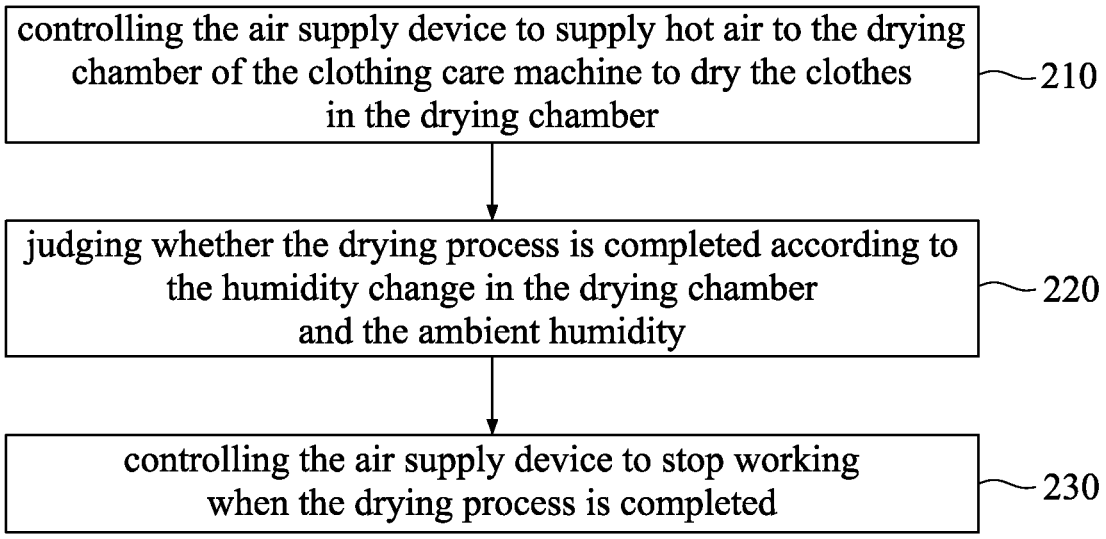
FIG. 2 is a flow chart of a control method of the clothing care machine according to a second embodiment.

FIG. 2 is a flow chart of a control method of the clothing care machine according to a second embodiment. Referring to FIG. 2, the control method of the clothing care machine of this embodiment is applied to the clothing care machine of the first embodiment, including the following steps:

Step 210, controlling the air supply device to supply hot air to the drying chamber of the clothing care machine to dry the clothes in the drying chamber;

Step 220, judging whether the drying process is completed according to the humidity change in the drying chamber and the ambient humidity;

Step 230, controlling the air supply device to stop working when the drying process is completed.

In this embodiment, judging whether the drying process is completed according to the humidity change in the drying chamber and the ambient humidity in step 220 may include:

determining the drying delay time according to the humidity change in the drying chamber, and determining the target drying humidity according to the ambient humidity;

starting timing when the chamber humidity is less than or equal to the target drying humidity; and judging that the drying process is completed when the timing reaches the drying delay time.

Specifically, when determining the drying delay time according to the humidity change in the drying chamber, the numerical change of the chamber humidity in a unit time is firstly calculated, and then the delay time corresponding to an interval where the numerical change is located is acquired as the drying delay time.

The specific details of the above steps may refer to the related description about the working process of the controller 16 in the first embodiment.

According to the control method of the clothing care machine in this embodiment, the air supply device is controlled to supply hot air to the drying chamber to dry the clothes, and then whether the drying process is completed is judged according to the chamber humidity and the ambient humidity, and when the drying process is completed, the air supply device is controlled to stop working, so that it is able to automatically judge whether the drying process is completed and stop working according to the chamber humidity and the ambient humidity, the judgment is more accurate so as to effectively improve the drying effect and reduce the energy consumption, and the intelligent degree is higher.

Third Embodiment

Figure 3:
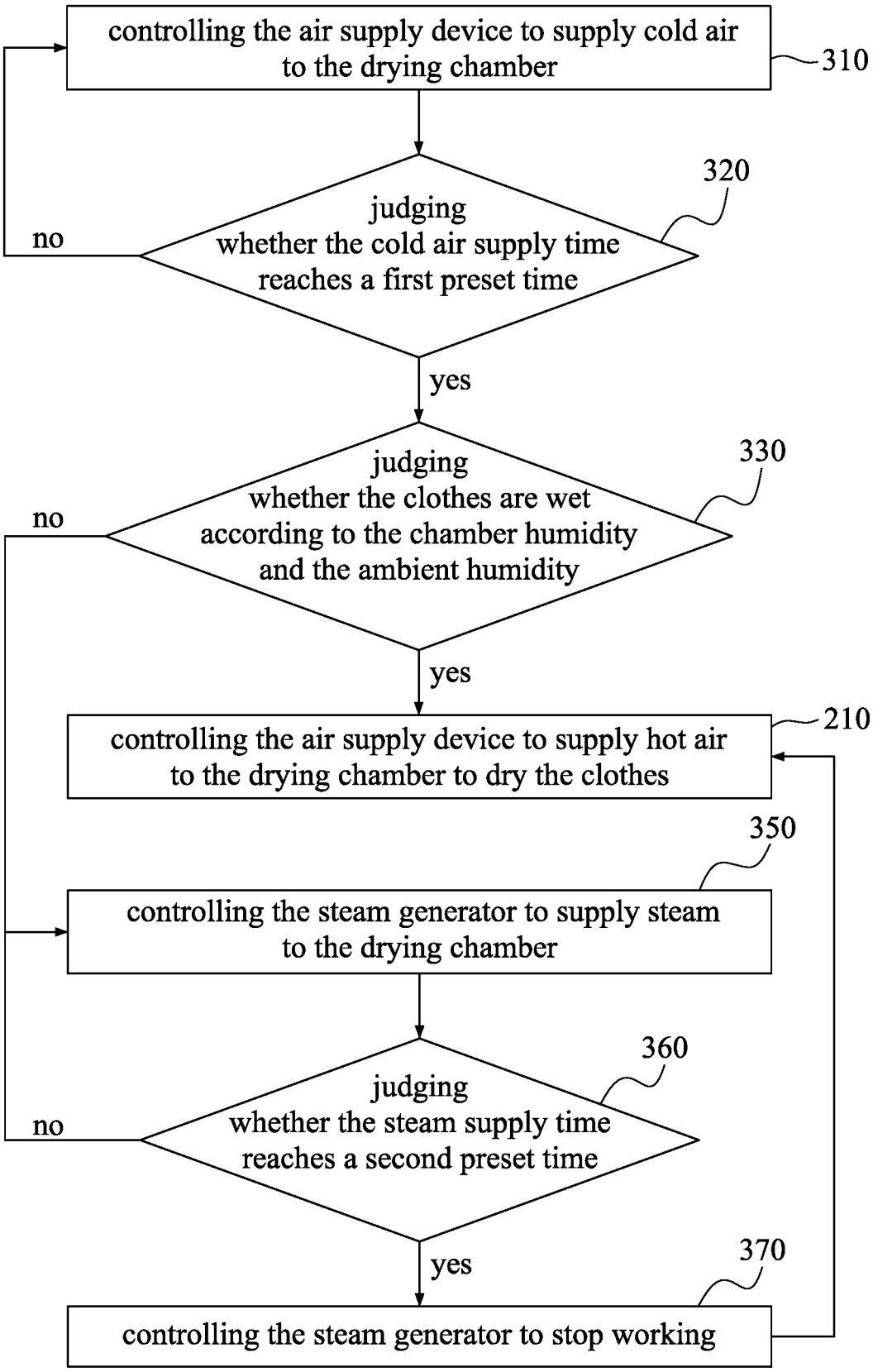
FIG. 3 is a flow chart of a control method of the clothing care machine according to a third embodiment.

FIG. 3 is a flow chart of a control method of the clothing care machine according to a third embodiment. Referring to FIG. 3, the control method of the clothing care machine of this embodiment is applied to the clothing care machine of the first embodiment, wherein the air supply device is further used for supplying cold air to the drying chamber, and the clothing care machine further includes a steam generator for supplying steam to the drying chamber. The main difference between the control method of the clothing care machine of this embodiment and the second embodiment is that before controlling the air supply device to supply hot air to the drying chamber in step 210 to dry the clothes, the following steps are further included:

Step 310, controlling the air supply device to supply cold air to the drying chamber;

Step 320, judging whether the cold air supply time reaches a first preset time; if so, performing step 330; otherwise, continuing to perform step 310;

Step 330, judging whether the clothes are wet according to the chamber humidity and the ambient humidity; if so, performing step 210; otherwise, performing step 350;

Step 210, controlling the air supply device to supply hot air to the drying chamber to dry the clothes;

Step 350, controlling the steam generator to supply steam to the drying chamber, and then performing step 360;

Step 360, judging whether the steam supply time reaches a second preset time; if so, performing step 370; otherwise, continuing to perform step 350;

Step 370, controlling the steam generator to stop working, and then performing step 210.

In this embodiment, judging whether the clothes are wet according to the chamber humidity and the ambient humidity in step 330 may include:

acquiring the humidity change in the drying chamber over the first preset time, and acquiring the initial difference between the chamber humidity and the ambient humidity before supplying the cold air; and judging whether the clothes are wet according to the humidity change in the drying chamber over the first preset time and the initial difference between the chamber humidity and the ambient humidity before supplying the cold air.

After step 210, it is judged whether the drying process is completed according to the chamber humidity and the ambient humidity as detected, and the air supply device is controlled to stop working when the drying process is completed. In judging whether the drying process is completed according to the chamber humidity and the ambient humidity as detected, the drying delay time is determined according to the humidity change in the drying chamber, and the target drying humidity is determined according to the ambient humidity; when the chamber humidity is less than or equal to the target drying humidity, timing is started; when the timing reaches the drying delay time, it is judged that the drying process is completed. Specifically, when determining the drying delay time according to the humidity change in the drying chamber, the numerical change of the chamber humidity in a unit time is firstly calculated, and then the delay time corresponding to an interval where the numerical change is located is acquired as the drying delay time.

In actual practice, the clothing care machine may not include the steam generator. In this case, if it is judged in step 330 that the clothes are not wet, the air supply device may be controlled not to supply hot air, that is, no drying is performed, so as to ensure safety, avoid overheating of the machine to damage the clothes, and avoid unnecessary drying to increase the energy consumption.

The specific details of the above steps may refer to the related description about the working process of the controller 16 in the first embodiment.

Before the drying process, by supplying cold air to promote moisture diffusion first and then combining the humidity change in the drying chamber over the first preset time and the initial difference between the chamber humidity and the ambient humidity before supplying the cold air, the control method of the clothing care machine in this embodiment can more accurately judge whether the clothes are wet, and thereafter, corresponding clothing care operations can be performed, to realize the intelligent startup and shutdown of the drying process.

In addition, if it is judged that the clothes are not wet before the drying process, the steam generator is controlled to supply steam to the drying chamber firstly for a second preset time to wet the clothes in the drying chamber to a certain extent, and thereafter, the steam generator is controlled to stop working, and then the air supply device is controlled to supply hot air to the drying chamber to dry the clothes, to automatically realize wrinkle removal and odor removal of the clothes and fully dry the clothes.

The above-mentioned embodiments only illustrate the principle and the effects of the present invention, and are not used to limit the present invention. Any person familiar with the technology may modify or change the above-mentioned embodiments without departing from the spirit and scope of this invention. Therefore, all equivalent modifications or changes made by a person with ordinary knowledge in the technical field without departing from the spirit and technical ideas disclosed in the present invention shall still be covered by the claims of the present invention.

What is claimed is:

1. A clothing care machine comprising:

a drying chamber for containing clothes; and a working system comprising an air supply device, a first humidity sensor, a second humidity sensor and a controller;

wherein the air supply device, the first humidity sensor and the second humidity sensor are each connected with the controller, the air supply device is communicated with the drying chamber and used for supplying hot air to the drying chamber, the first humidity sensor is disposed in the drying chamber to detect the humidity in the drying chamber, the second humidity sensor is disposed outside the drying chamber to detect the ambient humidity outside the drying chamber, the controller is used to control the air supply device to supply hot air to the drying chamber to dry the clothes, judge whether the drying process is completed according to the humidity change in the drying chamber and the ambient humidity, and control the air supply device to stop working when the drying process is completed;

wherein the controller is used for:

controlling the air supply device to supply hot air to the drying chamber to dry the clothes;

determining a drying delay time according to the humidity change in the drying chamber, and determining a target drying humidity according to the ambient humidity;

starting timing when the chamber humidity is less than or equal to the target drying humidity; and judging that the drying process is completed when the timing reaches the drying delay time.

2. The clothing care machine according to claim 1, wherein the air supply device is further used for supplying cold air to the drying chamber, and the controller is further used for:

controlling the air supply device to supply cold air to the drying chamber before controlling the air supply device to supply hot air to the drying chamber for drying the clothes;

judging, after the cold air supply time reaches a first preset time, whether the clothes are wet according to the chamber humidity and the ambient humidity as detected; and controlling the air supply device to supply hot air to the drying chamber to dry the clothes if it is judged that the clothes are wet.

3. The clothing care machine according to claim 2, wherein the working system further comprises a steam generator used for supplying steam to the drying chamber, and the controller is further used for:

controlling the steam generator to supply steam to the drying chamber if it is judged that the clothes are not wet; and when the steam supply time reaches a second preset time, controlling the steam generator to stop working and then controlling the air supply device to supply hot air to the drying chamber to dry the clothes.

4. A control method for a clothing care machine, comprising:

controlling an air supply device to supply hot air to a drying chamber of the clothing care machine to dry clothes in the drying chamber;

judging whether a drying process is completed according to the humidity change in the drying chamber and the ambient humidity; and controlling the air supply device to stop working when the drying process is completed;

wherein the step of judging whether the drying process is completed according to the humidity change in the drying chamber and the ambient humidity comprises:

determining a drying delay time according to the humidity change in the drying chamber, and determining a target drying humidity according to the ambient humidity;

starting timing when the chamber humidity is less than or equal to the target drying humidity; and judging that the drying process is completed when the timing reaches the drying delay time.

5. The control method of the clothing care machine according to claim 4, wherein the step of determining the drying delay time according to the humidity change in the drying chamber comprises:

calculating the numerical change of the chamber humidity in a unit time; and acquiring the delay time corresponding to an interval where the numerical change is located as the drying delay time.

6. The control method of the clothing care machine according to claim 4, wherein before the step of controlling the air supply device to supply hot air to the drying chamber of the clothing care machine, the control method further comprises:

controlling the air supply device to supply cold air to the drying chamber;

judging, after the cold air supply time reaches a first preset time, whether the clothes are wet according to the chamber humidity and the ambient humidity; and performing the step of controlling the air supply device to supply hot air to the drying chamber of the clothing care machine if it is judged that the clothes are wet.

7. The control method of the clothing care machine according to claim 6, wherein the step of judging whether the clothes are wet according to the chamber humidity and the ambient humidity comprises:

acquiring the humidity change in the drying chamber over the first preset time, and acquiring the initial difference between the chamber humidity and the ambient humidity before supplying the cold air; and judging whether the clothes are wet according to the humidity change in the drying chamber over the first preset time and the initial difference between the chamber humidity and the ambient humidity before supplying the cold air.

8. The control method of the clothing care machine according to claim 6, wherein the control method further comprises:

controlling the steam generator to supply steam to the drying chamber if it is judged that the clothes are not wet; and when the steam supply time reaches a second preset time, controlling the steam generator to stop working and then performing the step of controlling the air supply device to supply hot air to the drying chamber of the clothing care machine.

* * * * *